US006662819B1

(12) United States Patent
Watson

(10) Patent No.: US 6,662,819 B1
(45) Date of Patent: Dec. 16, 2003

(54) AUTOMATIC SWITCHOVER VALVE

(75) Inventor: David W. Watson, 102 Southwyck Dr., South Russell, OH (US) 44022

(73) Assignee: David W. Watson, South Russell, OH (US)

( * ) Notice: Subject to any disclaimer, the term of this patent is extended or adjusted under 35 U.S.C. 154(b) by 157 days.

(21) Appl. No.: 10/073,653

(22) Filed: Feb. 11, 2002

(51) Int. Cl.[7] ..... K16K 11/06
(52) U.S. Cl. ..... 137/113
(58) Field of Search ..... 137/113; 222/6

(56) References Cited

U.S. PATENT DOCUMENTS

| | | | | | |
|---|---|---|---|---|---|
| 2,285,686 | A | * | 6/1942 | Shanley | 22/6 |
| 2,641,273 | A | * | 6/1953 | Siebens | 222/6 |
| 2,786,640 | A | | 3/1957 | Zimmer | |
| 2,966,920 | A | * | 1/1961 | Oglesby | 222/6 |
| 3,131,708 | A | | 5/1964 | Knight | |
| 3,533,431 | A | | 10/1970 | Kuenzel et al. | |
| 3,633,606 | A | * | 1/1972 | Hay et al. | 137/113 |
| 4,018,244 | A | * | 4/1977 | Burns | 137/113 |
| 4,253,481 | A | * | 3/1981 | Sarlls, Jr. | 137/112 |
| 4,674,526 | A | | 6/1987 | Athanassiu | |
| 4,889,152 | A | | 12/1989 | Wilson | |
| 5,014,733 | A | | 5/1991 | Wilson | |
| 5,127,426 | A | * | 7/1992 | D'Archambaud | 137/113 |
| 6,173,729 | B1 | * | 1/2001 | Dey et al. | 137/113 |
| 6,257,268 | B1 | * | 7/2001 | Hope et al. | 137/112 |
| 6,296,008 | B1 | * | 10/2001 | Boyer et al. | 137/113 |

* cited by examiner

*Primary Examiner*—John Fox

(57) ABSTRACT

This invention relates generally to a valve system for the automatic switchover from one source of pressurized fluid to a second, or reserve, source. The switchover valve is actuated automatically in response to the first pressure source failing or reducing to a predetermined value whereupon the valve switches to a second pressure source while sustaining continuous operation. Upon switchover, the valve blocks the inlet of the depleted source such that it can be replaced with a recharged pressure source (gas bottle or liquid tank) without effecting the delivery of working pressure or necessitating additional, costly and complicated valving.

Switchover pressure is predetermined by the designed working surface of the axial end of the spool and the force of the opposing biasing spring. Unencumbered movement of the spool during switchover is afforded by the space between the spool end and the opposing spring. Movement through this space prevents false switchovers and exact control over switchover pressure. This invention has the major advantage over the prior art in that this switchover valve affords the economic utilization of a source pressure to it's minimum, but adequate supply pressure prior to switchover.

From the above description, those skilled in the art will understand that I have shown only one embodiment of the present invention and that the invention may be embodied, changed or otherwise improved or modified without departing from its spirit and scope. Thus the scope of the invention should be determined by the appended claims and their legal equivalents, rather than by the examples given.

4 Claims, 2 Drawing Sheets

AUTOMATIC SWITCHOVER VALVE

FEDERALLY SPONSERED RESEARCH

Not Applicable

SEQUENCE LISTING OR PROGRAM

Not Applicable

BACKGROUND

1. Field of the Invention

This invention relates to a valve used to automatically switchover from one pressure source to a backup or reserve pressure source upon the depletion or failure of the primary source such as with a system utilizing compressed gas cylinders.

BACKGROUND

2. Description of Prior Art

This invention relates generally to a valve system for the automatic switchover from one source of pressurized fluid to a second, or reserve, source in response to the depletion or failure of the primary pressure source. The invention specifically relates to a valve used to switchover from one compressed gas cylinder to a backup or alternate cylinder.

Prior art addressed automatic switchover utilizing the "shuttle valve" principle involving actuation by electrical solenoids and diaphragm regulators, U.S. Pat. No. 2,768,640 to Zimmer (1953). Others relied on a plurality of check valves, pistons, springs, and cavities for direction and/or control as in U.S. Pat. No. 3,131,708 to Knight (1964). Assemblies consisting of spools, diaphragms, springs, valves, and detents as in U.S. Pat. No. 4,674,526 to Athanassiu (1987) improved the operation of the valve but remained complex and expensive to build.

Simplification of the switchover valve was achieved through the utilization of a spool as evidenced in U.S. Pat. No. 3,533,431 to Kuenzel and Gilmore (1970). Spool valves by the nature of their design can be subject to false switchover, reverse flow, and a less than optimum operating pressure range. These important functional issues were overcome through the use of expensive check valves and/or pressure regulators incorporated in a switchover valve system as in the U.S. Pat. No. 4,889,152 to Wilson (1989). U.S. Pat. No. 5,014,733 to Wilson (1991) combined various features into one device that is expensive to manufacture and is susceptible to issues involving source pressure. U.S. Pat. No. 6,296,008 to Boyer and Pryor (2001) utilizes a locking mechanisnm which again, adds costs, but is effective in preventing false switchovers and also eliminates the need for check valves but still requires the use of expensive pressure regulators to insure reliable operation.

To insure reliability, costly features are incorporated into switchover valve systems. The disadvantages of the know switchover valve systems are:

(a) Susceptibility to reverse flow, requiring the added cost of check valves.

(b) Limited functional pressure range requiring the added cost and complexity of pressure regulators.

(c) Susceptibility to false or premature switching requiring mechanical locks to insure swift, accurate switching.

(d) Reliance on additional valving to isolate the switchover system during pressure source replenishment especially where compressed gas cylinders are being replaced.

OBJECTS AND ADVANTAGES

There are several objects and advantages of the present invention including the provision of a switchover valve for the automatic switchover from a primary source of pressurized fluid (e.g. a compressed gas cylinder) to a second source in response to the depletion or failure of the primary pressure source that is:

(a) simpler, more compact, and is less costly to manufacture;

(b) more reliable given it's simple construction;

(c) a failsafe control which is immune to false switchover;

(d) impervious to reverse flow;

(e) more economical given that it affords the utilization of source pressure to it's minimum but adequate, supply pressure prior to switchover;

(f) functional without the need for costly valving to isolate source pressure.

The present invention advances the prior art through simplification of operation and economy of construction. These and all other objects and advantages comprise a switchover valve system for delivering a pressurized fluid from a plurality of sources such that automatic switchover occurs in response to the depletion or failure of a pressure source, which switchover to another pressure source is not effected by source pressure differentials, which switchover occurs at a predetermined source pressure, which operation of the valve is unencumbered during switchover and therefore failsafe, free of reverse flow, and reliable in operation.

SUMMARY

The above is generally embodied in this invention for the automatic switchover from one source of pressurized fluid to another source of pressurized fluid in response to the failure or depletion of the one source wherein a tubular valve body comprises two inlets, one for each said source, for communication with an outlet. A spool, with a tubular feature, is moveable in the tubular body, which sets one inlet in communication with the outlet such that the other inlet is closed to the outlet. The spool's tubular feature directs the communicated (inlet) pressure upon its self such that it holds the spool position against the apposing axial spring which is biased against said pressure. The closed inlet is rendered ineffectual in this position. The spool is responsive to the spring bias pressure such that with the depletion of said holding pressure the spring bias overcomes said holding pressure at a predetermined value and said spring moves the spool unencumbered to a position such that the previously blocked inlet is opened releasing fluid pressure which sets the spool in communication with the outlet such that the original inlet is closed to the outlet. The spool's tubular feature directs the newly communicated (inlet) pressure upon it's self such that it holds the spool position against the axial spring, which is biased against said pressure; the closed original inlet is rendered ineffectual in this position.

DRAWINGS

Drawing Figures

The present invention is depicted in the accompanying drawings. The following description of the invention references the accompanying drawings and the characters listed therein.

REFERENCE NUMERALS IN DRAWINGS

| | | | |
|---|---|---|---|
| 1 | Valve Body | 8 | Compression Spring |
| 2 | Inlet Port | 9 | Compression Spring |
| 3 | Inlet Port | 8a | Pressure Chamber |
| 4 | Outlet Port | 9a | Pressure Chamber |
| 5 | Spool | 10 | Tubular Passage |
| 2a | Cavity | 11 | Tubular Passage |
| 3a | Cavity | 12 | Switchover Valve |
| 6 | EndCap | 13 | Gap |
| 7 | EndCap | 14 | Gap |
| 6a | Spool Stop | 22 | Compressed Gas Cylinder |
| 7a | Spool Stop | 33 | Compressed Gas Cylinder |
| | | 44 | Pressure Regulator |

DETAILED DESCRIPTION OF THE PREFERRED EMBODIMENT

Figure 2:
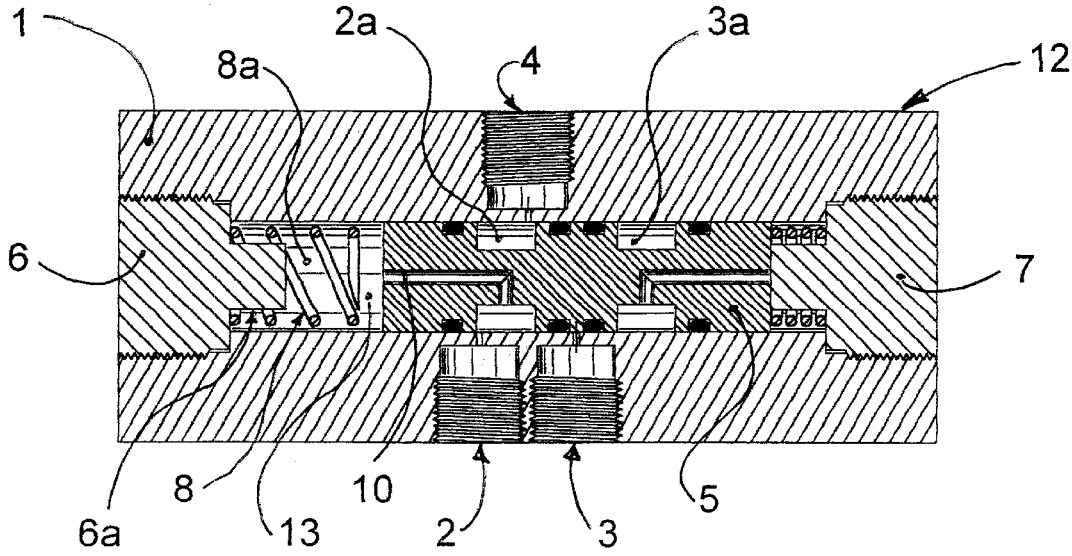
FIG. 2 is a sectional view of the switching valve apparatus with the valve spool shifted fully in one direction.
Figure 3:
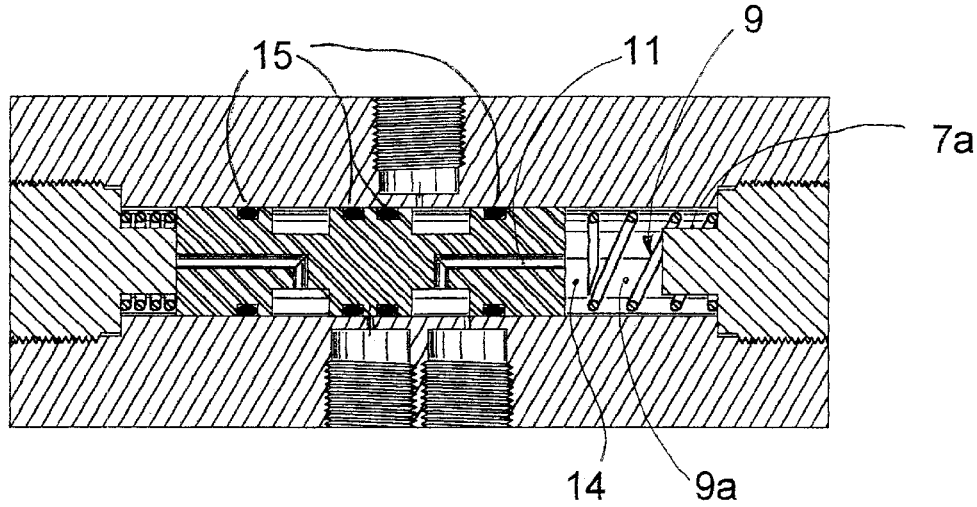
FIG. 3 is a sectional view of the invention showing the valve spool shifted to utilize a different inlet port from the view in FIG. 2.

Description—FIGS. 2, 3

FIG. 2 depicts, a valve system, designated as a whole by the reference number 12, for automatic switchover from one supply of pressurized fluid to another supply of pressurized fluid in response to failing or depletion of the one supply thereof. The switchover valve of this invention comprises a valve body 1 having two inlet ports 2 and 3, and an outlet port 4.

The valve body 1 is of one-piece construction. An axial cylindrical bore extends through the body from left to right with the bore ends enlarged to accommodate the end caps 6 and 7. Two inlet ports, 2 and 3, and an outlet port 4 communicate with the central bore. A tubular spool 5 of such configuration that it has a center and ends with a larger diameter than two reduced cross sections which create cavities 2*a* and 3*a* where tubular passages 10 and 11 communicate pressure to chambers 8*a* and 9*a*. O-rings 15 are utilized such that chambers 8*a*, 9*a*, 13, and 14 are isolated and sealed. The diameter of the spool 5 is slidable in the bore of said body acting as a piston in response to the pressure communicating from chambers 2*a* and 3*a* through passages 10 and 11 respectively into chambers 8*a* and 9*a* respectively.

Springs 8 and 9 fit freely in the chambers 8*a* and 9*a* and are guided by the smaller projected diameters 6*a* and 7*a* of the end caps 6 and 7. The axial length of the smaller projected diameter 6*a* and 7*a* also sets the axial travel of said tubular spool. In addition, said projections ensure that said springs do not over compress by stopping said tubular spool short of the stacked length of said compressed spring.

The tubular spool 5 moveable in the valve body 1 between the position shown in FIG. 2, establishing communication for delivery of fluid pressure from the one inlet 2 to the outlet 4 and blocking the other inlet 3 to the outlet, and a position shown in FIG. 3 establishing communication for the delivery of fluid pressure from the other inlet 3 to the outlet 4 and blocking the other inlet 2 to the outlet. The tubular spool 5 is subject to fluid pressure supplied by inlet port 2 for moving it to the said position (FIG. 2), and to pressure supplied by inlet port 3 for moving it from the first mentioned position to the second mentioned position (FIG. 3). The axial free length of the springs 8 and 9 in their respective cavities 8*a* and 9*a* are sized such that there is space 13 and 14 between said spring length and said spool 5 and said end caps 6 and 7. The spring bias moves the tubular spool 5 as a result of a drop in inlet pressure delivered by said tubular spool into said spool chamber in either of the before mentioned positions.

The material of said springs are coil compression springs, however it may be readily apparent to those skilled in the art that it is also suitable to utilize other capable biasing means.

O-rings 15 are utilized as a sealing material, however it may be readily apparent to those skilled in the art that it is also suitable to utilize other capable sealing materials.

Advantages

From the above description of my switchover valve, a number of advantages become evident:

(a) The construction is significantly less complicated than the prior art and therefore is more economical to manufacture.

(b) Given the simplicity of the construction, the present invention is less complicated and therefore more reliable.

(c) False switchovers are avoided given the predetermined bias of the spring force acting on the chamber pressure of 8*a* and 9*a* and given that the alternate source pressure is rendered ineffectual.

(d) Whereas, the depleted pressure source and the switchover pressure source do not communicate, the present invention is immune to reverse flow.

(e) Given that the reserve pressure is rendered ineffectual; switchover pressure is determined by the bias spring pressure working against the supply pressure. This bias force can be set at a minimum economic pressure without the added cost of pressure regulators.

(g) Given that that the reserve pressure is rendered ineffectual, performance and reliability do not necessitate the need for costly pressure source regulators.

Figure 1:
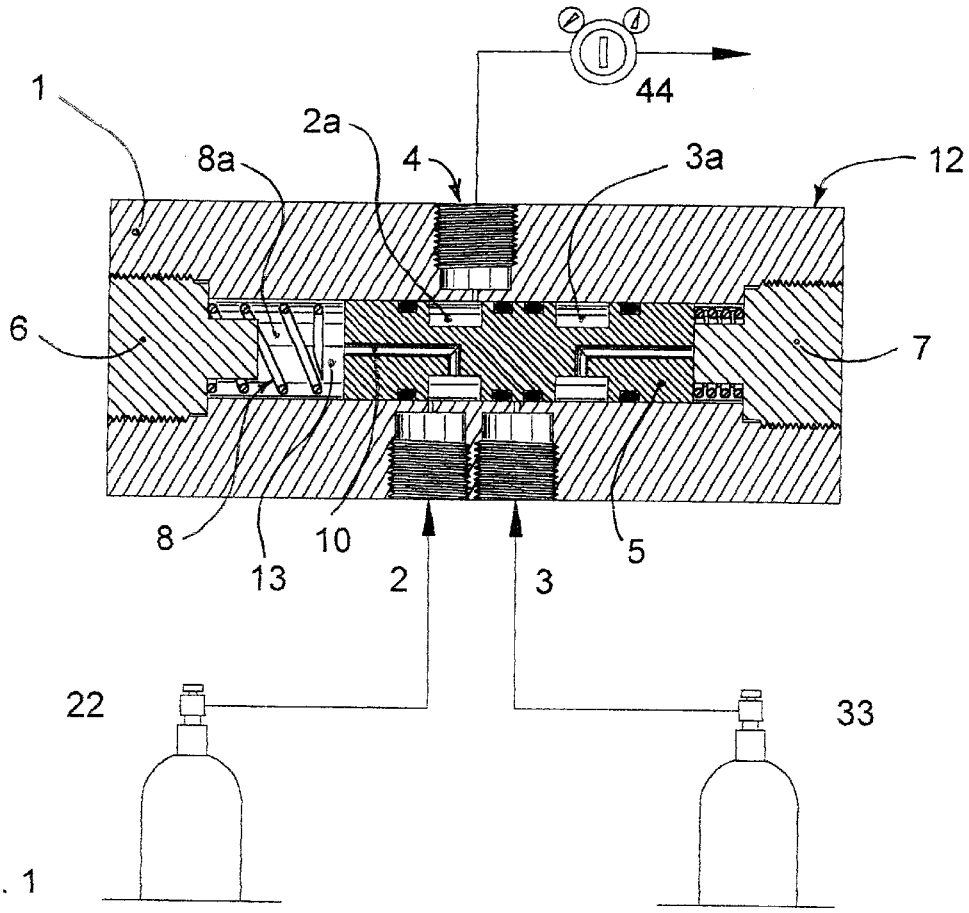
FIG. 1 is a perspective view of the present switching valve system.

Operation—FIGS. 1, 2, 3

Use of the automatic switchover valve in a pressure system has the inlets 2 and 3 connected directly from their respective pressure sources. FIG. 1 shows compressed gas cylinders 22 and 33 connected directly to inlets 2 and 3 without regulation of the source pressure. With the tubular spool 5 positioned as in FIG. 2, fluid pressure enters inlet 2 and flows into chamber 2*a* and through passage 10 into chamber 8*a*. Pressure in 2*a* is directed to outlet 4 for system use. Pressure in chamber 8*a* applies axial force to the end of the spool 5, much like force on a piston, which holds the spool to the right against the bias of spring 9. The spool is held against end cap 7, contacting the smaller projected diameter 7*a*.In this position said spool blocks the alternate inlet, in this case inlet 3, such that regardless the pressure from said inlet it is ineffectual on the movement of the spool 5.

As working pressure diminishes, the source pressure from inlet 2 acting in chamber 8*a* falls to a predetermined pressure limit (such as 60 psig) allowing the bias of spring 9 to overcome the pressure in chamber 8*a*. As the bias of spring 8 moves the spool 5, said spool is unencumbered as it travels to the left toward spring 8. The distance traveled, gap 13, allows inlet 3 to initiate communication with chamber 3*a* before outlet 4 is blocked from the pressure from inlet 2. While inlet 2 is still in communication with outlet 4, inlet 3 is exposed to chamber 3*a*, and in turn passage 11, which results in an increase in pressure in chamber 9*a*. The resulting pressure differential in chambers 9*a* and 8*a* is such that the greater pressure in chamber 9*a* working on spool 5 moves said spool to the left such that switchover is virtually instantaneous. This is critical in many applications that require an uninterrupted flow of pressure.

The pressure supply device, in this case the compressed gas cylinder 22, may then be changed without the need of a costly shutoff valve. After the reserve supply is replenished (cylinder 22 is recharged and reconnected) and the working pressure in inlet 3 diminishes, the source pressure from inlet 3 acting in chamber 9*a* falls allowing the bias of spring 8 to overcome the pressure in chamber 9*a*. As the bias of spring 8 moves the spool 5, said spool is unencumbered as it travels to the right toward spring 9. The distance traveled, gap 14, allows inlet 2 to initiate communication with chamber 2*a* before outlet 4 is blocked from the pressure from inlet 3. While inlet 3 is still in communication with outlet 4, inlet 2 is exposed to chamber 2*a,* and in turn passage 10, which results in an increase in pressure in chamber 8*a*. The resulting pressure differential in chambers 8*a* and 9*a* is such that the greater pressure in chamber 8*a* working on spool 5 moves said spool to the right such that switchover is virtually instantaneous.

CONCLUSION, RAMIFICATIONS, AND SCOPE

From the foregoing, those skilled in the art will understand that the present invention has many advantages. Accordingly, the embodiments described herein can be utilized for the automatic switchover from one pressure source to another. Typically, compressed gas cylinders are charged to 2200 psig or higher. Prior art utilizes pressure regulators to reduce this to a few hundred psig, or lower, in order for the switching valve to properly function. By isolating the reserve pressure source and rendering it ineffectual, source pressure regulators are not needed thus reducing system costs.

Reverse flow in the prior art would typically result from a differential in pressure resulting in fluid flow from a higher-pressure source (typically the reserve source) to another pressure source (typically when the other source was significantly reduced prior to switchover). Isolating the reserve pressure source deems it ineffectual and thus eliminates reverse flow.

Pressure differential devices rely on both pressure supplies to effect automatic switchover. Often times errant readings result in false switchovers that again are avoided with the reserve pressure deemed ineffectual.

Unencumbered spool movement and isolation of the reserve pressure at the time of switchover provides virtually instantaneous switchover.

In a compressed gas application, utilization of as much cylinder pressure as possible is more cost effective and economical. Given the embodiments described above the present invention can be utilized with springs biased to a minimum but effective switchover pressure which conserves resources making the present invention less costly to operate.

Applications of this invention include but are not limited to the delivery of medical, industrial, and commercial compressed gases for example oxygen, nitrogen, and carbon dioxide. Industrial gases including acetylene, nitrogen, argon, and others that are commonly delivered in compressed gas cylinders and interruption of service can result in costly shutdowns, scrap and delays. Medical applications, such as the supply of oxygen to patients for life support, require uninterrupted gas supply. Commercial use of the present invention in the delivery of CO2 (for the carbonation of beverages) increases service reliability, avoids spoilage, and improves customer satisfaction.

Reading the foregoing it is apparent that the present invention can be utilized in applications involving the delivery of gas or liquid and is not limited strictly to gas applications.

Having described the invention, I claim:

1. A valve for automatic switchover from a plurality of pressure sources to a common outlet in response to failing or failure of said source, said valve comprising:

a valve body having first and second inlet ports for connecting to said pressure sources and a common outlet;

a valve body having an internal bore communicating with said first inlet, said second inlet, and said outlet;

a valve member in the form of a spool, moveable in said bore between a first position where fluid pressure is communicated with said first inlet and said outlet and blocking said second inlet, and a second position where fluid pressure is communicated with said second inlet and said outlet and blocking said first inlet;

said spool with means of communicating with each said inlet and first and second piston effect chambers in said valve bore;

said spool being subject to fluid pressure supplied to said first inlet for moving it to the first mentioned position and to fluid pressure supplied to said second inlet for moving it to the second mentioned position;

springs positioned on either end of said spool, biased axially against said piston effect of said spool;

pressure force of said piston effect set against said spring bias whereas minimum source pressure is overcome by said spring;

a gap configured between said spool and said spring to allow unencumbered movement of said spool upon depletion of said piston effect pressure in said chamber.

2. The valve claimed in claim 1 wherein said inlet pressure acting as in a piston chamber holds said spool until pressure is depleted or fails to a point the opposing spring bias moves said spool releasing said pressure from said alternate source.

3. The valve claimed in claim 1 wherein said spool, moveable between said first position and said second position, upon switchover moves through said gap such that the movement is unencumbered effecting virtually instantaneous switchover.

4. The valve claimed in claim 1 having end caps closing said cylindrical bore in said valve body with projections stopping over compression of said springs and effecting an exact stop location for said position of said spool.

* * * * *